US007144102B2

(12) United States Patent
Hengesbach et al.

(10) Patent No.: US 7,144,102 B2
(45) Date of Patent: Dec. 5, 2006

(54) SUPRESSION OF MARANGONI EFFECT ON THE CATCHER FACE

(75) Inventors: Paul K. Hengesbach, Kettering, OH (US); John C. Loyd, Beavercreek, OH (US)

(73) Assignee: Eastman Kodak Company, Rochester, NY (US)

( * ) Notice: Subject to any disclaimer, the term of this patent is extended or adjusted under 35 U.S.C. 154(b) by 280 days.

(21) Appl. No.: 10/839,408

(22) Filed: May 5, 2004

(65) Prior Publication Data

US 2005/0248641 A1 Nov. 10, 2005

(51) Int. Cl.
*B41J 2/02* (2006.01)
*B41J 2/185* (2006.01)

(52) U.S. Cl. ..... 347/73; 347/90

(58) Field of Classification Search ..... 347/22, 347/29, 32, 36, 73, 74, 75, 76, 90
See application file for complete search history.

(56) References Cited

U.S. PATENT DOCUMENTS 5,337,071 A * 8/1994 East et al. ..... 347/77
5,489,929 A * 2/1996 Vago ..... 347/55
6,527,363 B1 * 3/2003 Bowling et al. ..... 347/36
6,688,736 B1 * 2/2004 Tunmore et al. ..... 347/90
6,742,876 B1 * 6/2004 Enz ..... 347/75
6,793,327 B1 * 9/2004 Huliba ..... 347/73
6,962,411 B1 * 11/2005 West et al. ..... 347/90

* cited by examiner

*Primary Examiner*—Anh T. N. Vo
(74) *Attorney, Agent, or Firm*—The Buskop Law Group, P.C

(57) ABSTRACT

The method for controlling ink migration onto a catcher of an ink jet print station from catch condition using a low surface tension ink entails bringing an ink jet print station using low surface tension ink into catch condition with the eyelid sealably engaging the catcher and the catcher flow pan, and using an eyelid actuator to unseal the eyelid forming a gap between the catcher flow pan, the catcher, and the eyelid. The method ends by operating the ink jet print station with the eyelid unsealed to suppress migration of the low surface tension ink onto the catcher during standby mode.

6 Claims, 5 Drawing Sheets

SUPRESSION OF MARANGONI EFFECT ON THE CATCHER FACE

FIELD OF THE INVENTION

The present embodiments relate to an ink jet printing system.

BACKGROUND OF THE INVENTION

An ink jet printing system includes components such as a drop generator with an orifice structure for making an array of ink jets that project ink drops, a charge device to selectively charge the ink drops formed by the drop generator, and a catcher to collect selectively charged drops not intended for printing. An eyelid is a device used to seal against the catcher to facilitate the startup sequence of the ink jet printing system. The eyelid is conventionally operated to seal against the vertical surface, and the catcher flow pan of the catcher to prevent leakage of ink out of the printhead before a catch state is established for the ink jet printing system.

Typically, after the catch state has been established for the ink jet printing system, the eyelid is held closed until the printer is required to print, at which time the eyelid is opened and allows the print drops to exit through a narrow slit between the eyelid seal and the catching surface.

Migration of the ink can reach the charging leads on the charge device, and can create a short between the leads. Typically, the ink jet printer responds by shutting down the printhead and fluid system, and alerting the operator to the problem. The operator has to stop his print job and service the printer, usually by restarting it. Also, the migrating ink can dry and interfere with the impacting drops, causing them to skip off the catcher and hit the print media, thus creating a printing defect. The operator must then service the printhead, usually by manually shutting down the printhead and fluid system, followed by a restart or cleaning sequence and restart. Again, the print job has to be stopped.

In the cases of the operator's intervention and stopping of the print job, the productivity of the printing process is impaired and the reliability of the printer is impacted.

A need exists to improve the reliability of the ink jet printer by reducing the shorting out of the leads and reduce the effect of the migrating ink on the catcher.

The present embodiments described herein were designed to meet these needs.

SUMMARY OF THE INVENTION

A method for controlling ink migration onto a catcher of an ink jet print station from catch condition using a low surface tension ink in an ink jet print station. The ink jet print station includes a drop generator with an orifice structure forming a jet array, a drop generator connected to an ink reservoir, a charge device for charging recycle drops from the jet array, a catcher with attached catcher flow pan, an eyelid with eyelid actuator for sealably engaging the catcher and catcher flow pan, and an ink return line in communication with to the catcher flow pan. The method entails bringing an ink jet print station using low surface tension ink into catch condition with the eyelid sealably engaging the catcher and the catcher flow pan. The eyelid actuator is used to unseal the eyelid, forming a gap between the catcher flow pan, catcher, and the eyelid. The method ends by operating the ink jet print station with the eyelid unsealed to suppress migration of the low surface tension ink onto the catcher during standby mode.

BRIEF DESCRIPTION OF THE DRAWINGS

In the detailed description of the preferred embodiments presented below, reference is made to the accompanying drawings, in that.

The present embodiments are detailed below with reference to the listed Figures.

DETAILED DESCRIPTION OF THE INVENTION

Before explaining the present embodiments in detail, it is to be understood that the embodiments are not limited to the particular descriptions and that it can be practiced or carried out in various ways.

One of the benefits of the embodied methods is the suppression of the ink that is disposed on the face of the catcher. Ink, if allowed to spread unchecked on the catcher, can migrate up to the charge device, which is the charge plate in certain embodiments. If ink spreads to the charge device, the ink can cause a short in the charge plate that then shuts down the printing system. The embodied methods prevent this migration.

The present methods were designed to use an unsealed eyelid to avoid the formation of a film or ink that interferes with the normal trajectories of the ink drops from a drop generator in the print station.

The embodied methods have been designed to produce a higher quality printing with less failure, and accordingly, a reduced need for field maintenance because the method reduces shorts of the charge plate due to the migration of ink.

Spreading of the ink on the catcher is due to the local variations in surface tension produced by the evaporation of the solvent, a process known as the Marangoni Effect. These embodied methods move the eyelid out of the way into an unsealed position during the printing and standby modes. By keeping the eyelid open, the spreading of ink on the catcher face, and ink build up on the eyelid is inhibited. The inhibition of the horizontal or vertical migration of ink along the catcher helps to prevent charge plate shorts.

The embodied methods add versatility because additional solvent based inks with higher volatilities can be used with controlled migration of the ink.

Figure 1:
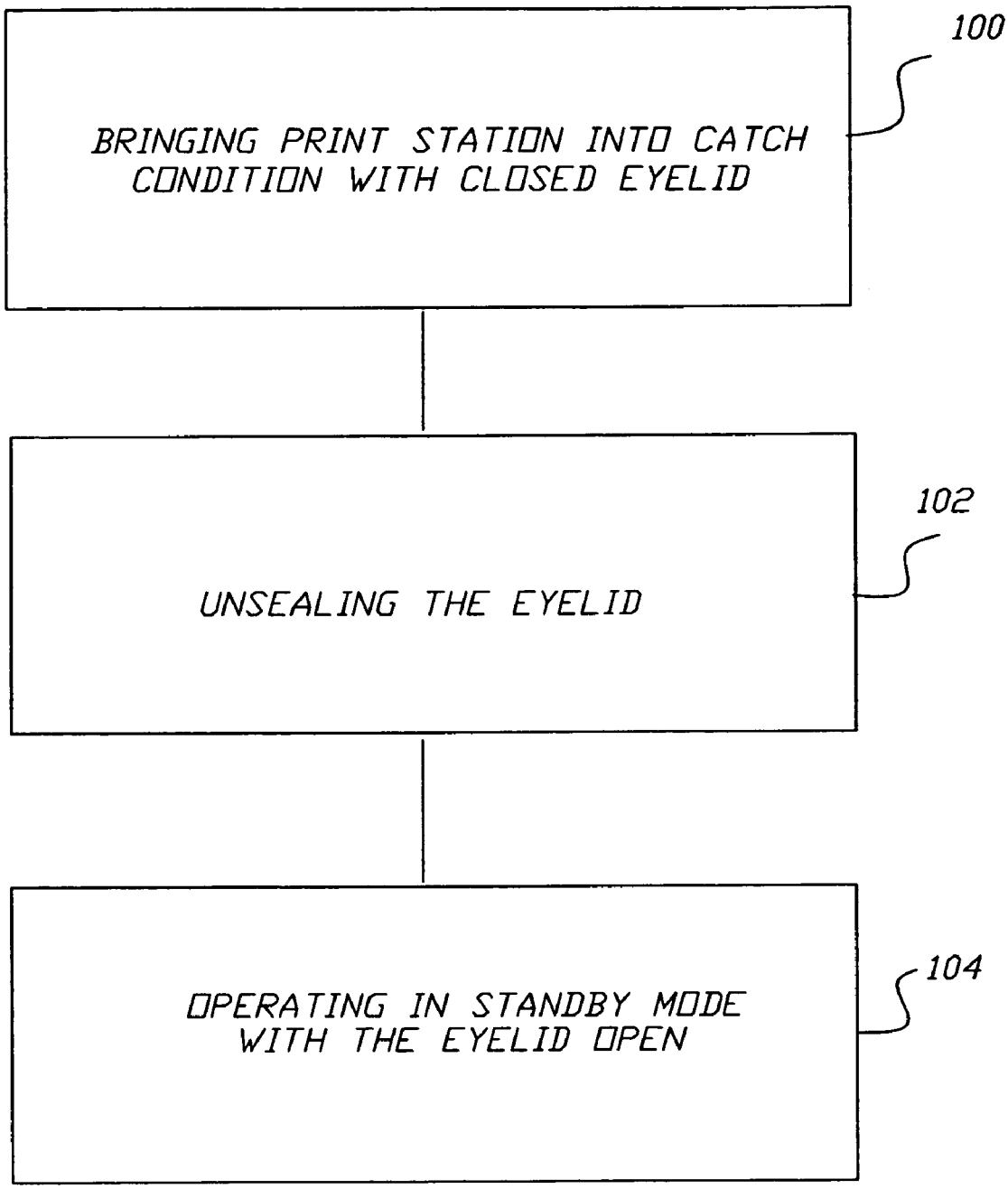
FIG. 1 depicts a flow chart of an embodiment of a method for keeping a catcher of an ink jet print station free of low surface tension ink.

Referring now to the figures, FIG. 1 depicts a schematic of a method for controlling ink migration onto a catcher of an ink jet print station from catch condition using low surface tension ink. An example of an ink jet print station is a Kodak Versamark DT92 print station available from Kodak Versamark of Dayton, Ohio.

This method involves using an ink jet print station with a drop generator with an orifice structure with orifices for forming a jet array, and a drop generator attached to the ink supply line that is connected to an ink reservoir. The print station has a charge device for charging recycle drops from the jet array, and a catcher with an attached catcher flow pan.

The ink jet print station has an eyelid with an eyelid actuator for sealably engaging the catcher and catcher flow pan, and an ink return line in communication with to the catcher flow pan.

The method is depicted in FIG. 1. The method begins by bringing an ink jet print station, using low surface tension ink, into catch condition with the eyelid closed (Step 100), such as in a sealable engagement with the catcher and the catcher flow pan. The method continues by unsealing the eyelid using an eyelid actuator, forming a gap between the catcher flow pan, the catcher, and the eyelid (Step 100). The method ends by operating the ink jet print station with the eyelid unsealed to suppress migration of the low surface tension ink onto the catcher during standby mode (Step 104).

Figure 2:
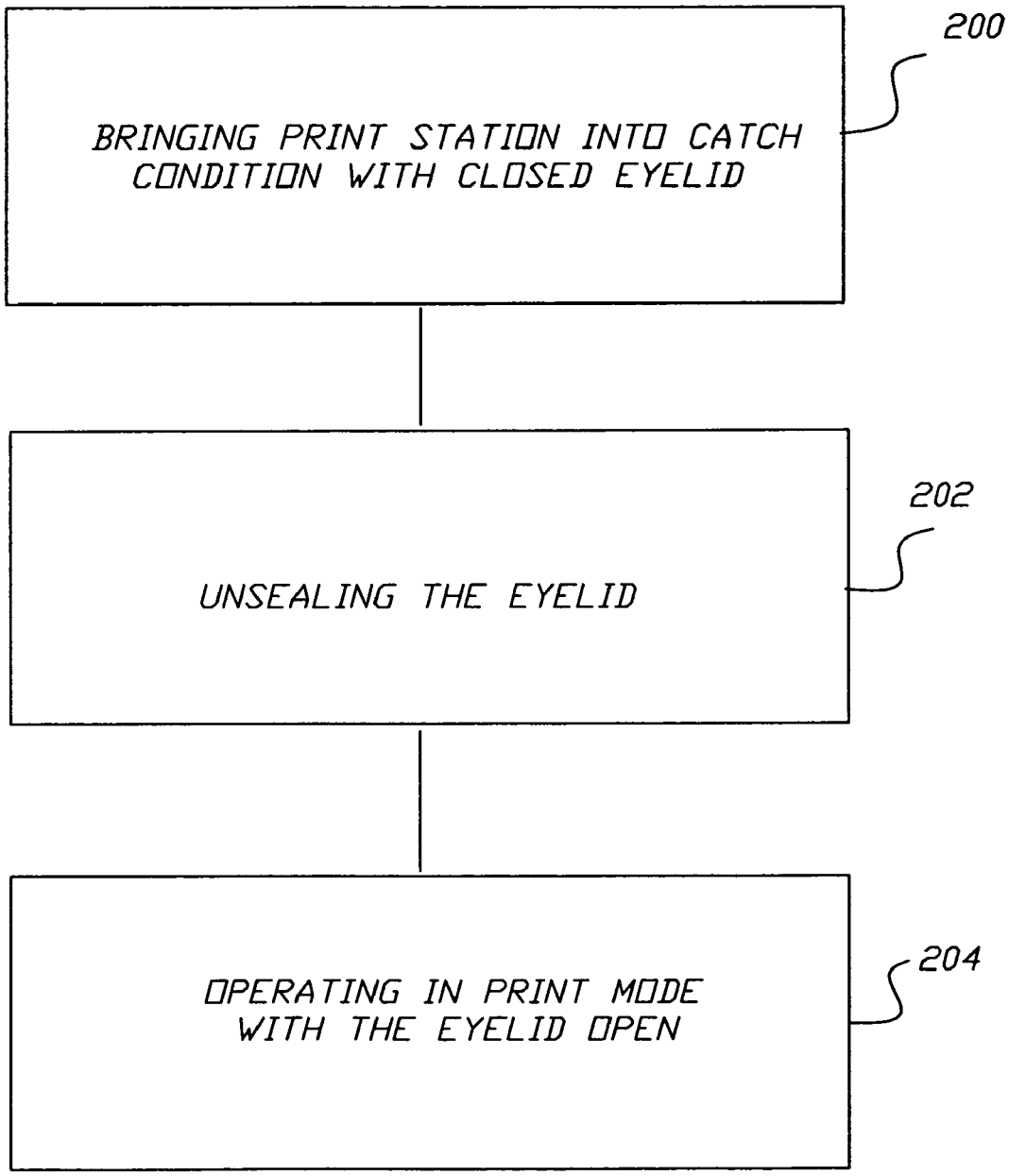
FIG. 2 depicts a flow chart of an embodiment of a method for controlling ink migration in a print station.

An alternative embodiment of the method involves the steps shown in FIG. 2. The initial step is bringing an ink jet print station using low surface tension ink into catch condition with the eyelid sealably engaging the catcher and the catcher flow pan (Step 200). The method continues by using an eyelid actuator to unseal the eyelid, forming a gap between the catcher flow pan, the catcher, and the eyelid (Step 202). The method ends by operating the ink jet print station with the eyelid unsealed to suppress migration of the low surface tension ink onto the catcher during print mode (Step 204).

Figure 3:
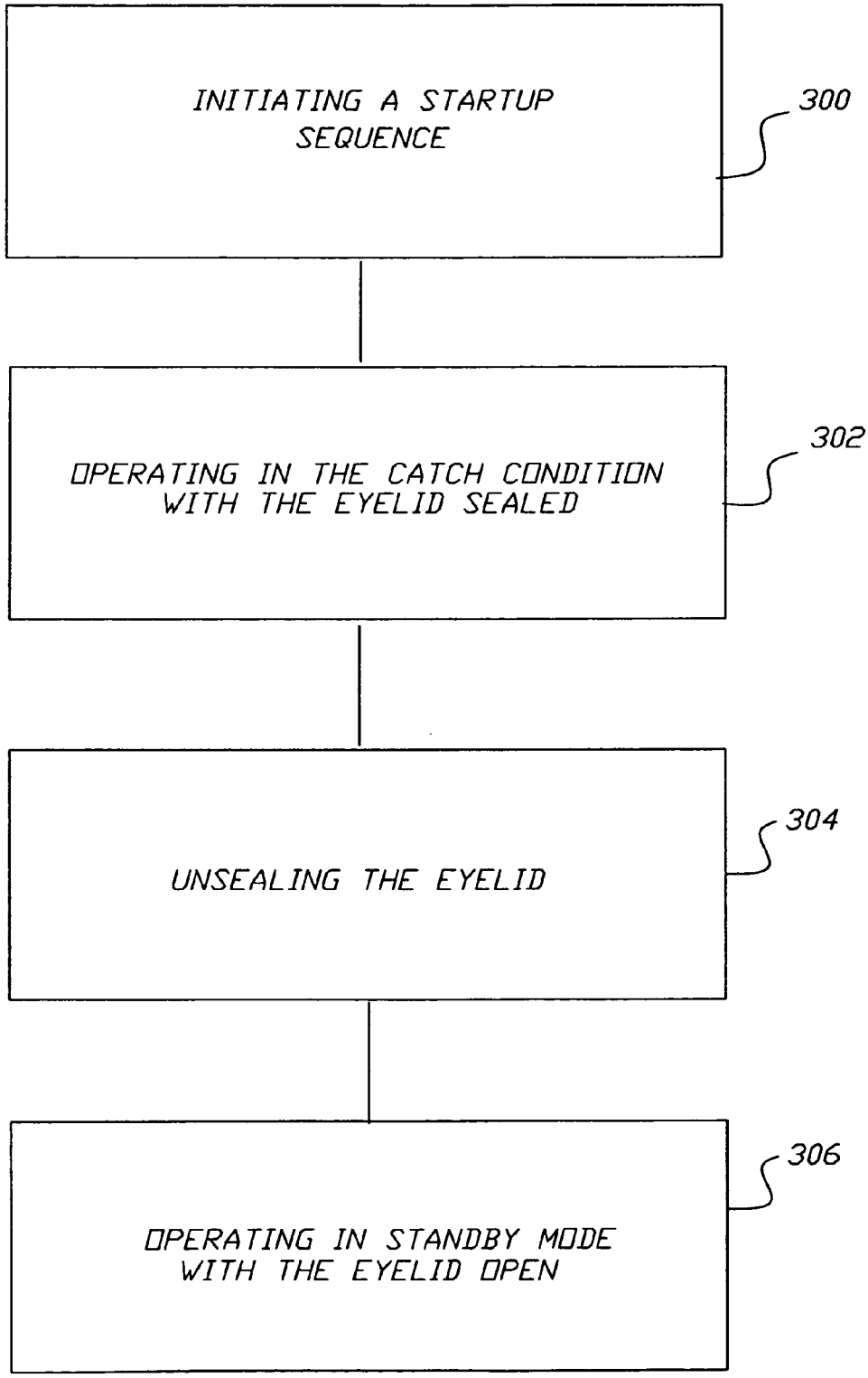
FIG. 3 depicts a flow chart of an embodiment of a method for controlling ink migration in a print station.

Another embodiment of the method involves the steps shown in FIG. 3. The method begins by initiating a start up sequence for an ink jet print station (Step 300), and operating an ink jet print station using low surface tension ink in catch condition with the eyelid sealably engaging the catcher and the catcher flow pan (Step 302). The method continues by unsealing the eyelid with the eyelid actuator, forming a gap between the catcher flow pan, the catcher, and the eyelid (Step 304). The method ends by operating the ink jet print station with the eyelid unsealed to suppress migration of the low surface tension ink onto the catcher during standby mode (Step 306).

This method applies to an ink jet printing system that has a reservoir of ink connected to a drop generator by an ink supply line. An optional filter may be between the ink supply line and the drop generator. The drop generator has an orifice structure with many small diameter orifices. Typically, more than 100 small diameter orifices create a plurality of ink jets that can provide drops that are positioned adjacent to charging electrodes on a charge device.

The charging device is used to charge selective ink drops as the drops break off from the ink jets. The charge drops are deflected so that the drops strike a catcher, while uncharged drops are not deflected allowing them to strike the print media to form an image. An eyelid is used in the system. The catcher receives the deflected ink drops and sends the drops via a catcher return line back to a reservoir. Various pumps and valves can be used in the process to control the flow of ink. One or more controllers can be used to monitor and control fluid flow, and engage the various devices of the printing system.

Figure 4:
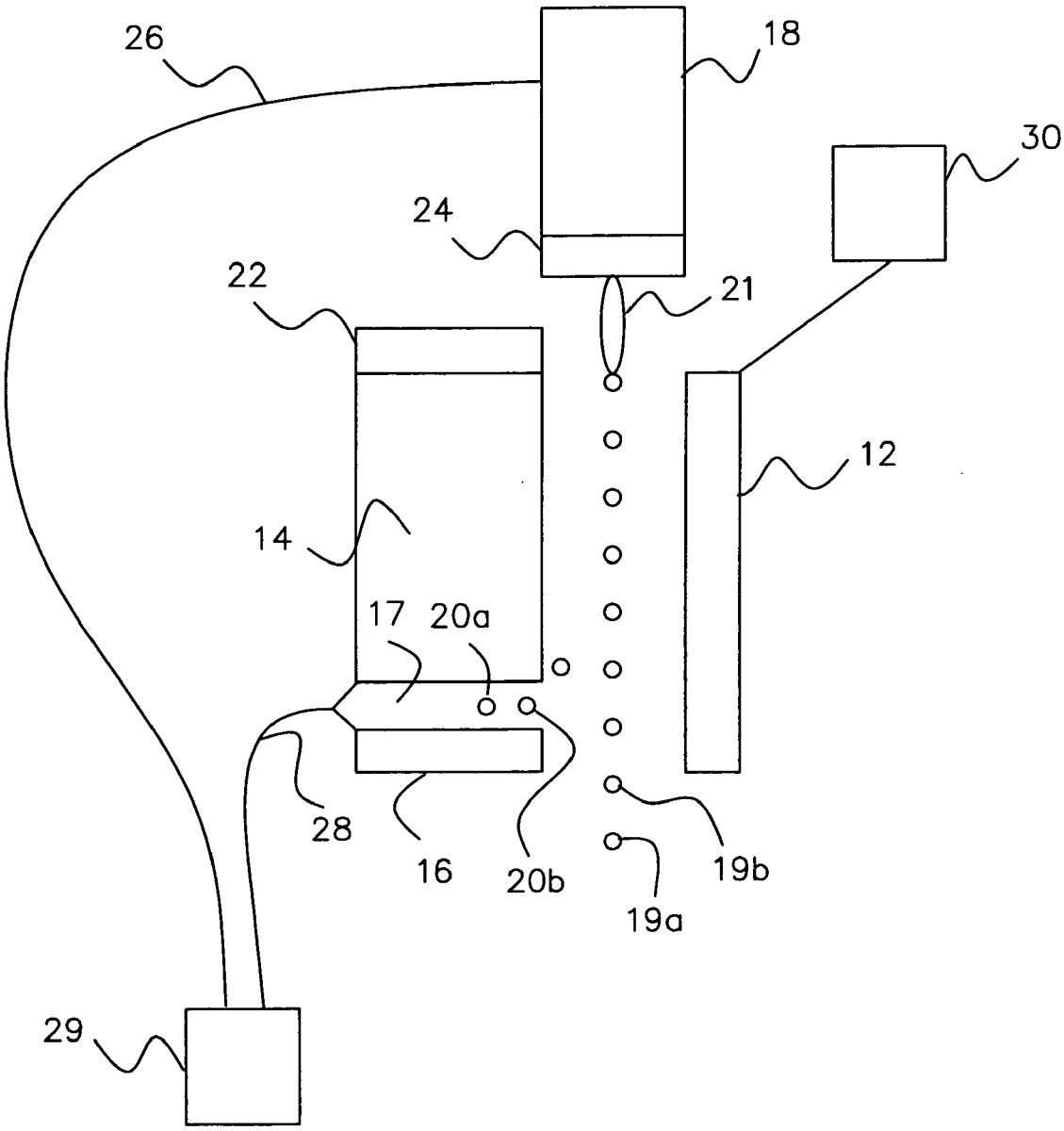
FIG. 4 depicts a schematic of the equipment usable in the embodied methods.

FIG. 4 depicts the equipment used in the methods described above. FIG. 4 shows a drop generator 18 with an orifice structure 24 attached to the drop generator. The orifice structure 24 has a plurality of orifices that create a jet array 21. The jet array 21 creates print drops 19*a* and 19*b* and non-print drops 20*a* and 20*b*. Non-print drops 20*a* and 20*b* are deflected by the charge device 22 so that the drops strike the catcher 14. The ink flows down the catcher 14 entering the channel 17 formed between the catcher 14 and the catcher flow pan 16, as seen in more detail in FIG. 5.

Returning to FIG. 4, the channel 17 is connected to the ink return line 28 through which the ink from non-print drops flows to the reservoir 29. A ink supply line 26 provides the needed ink, such as volatile ink, to the drop generator from the reservoir 29.

Figure 5:
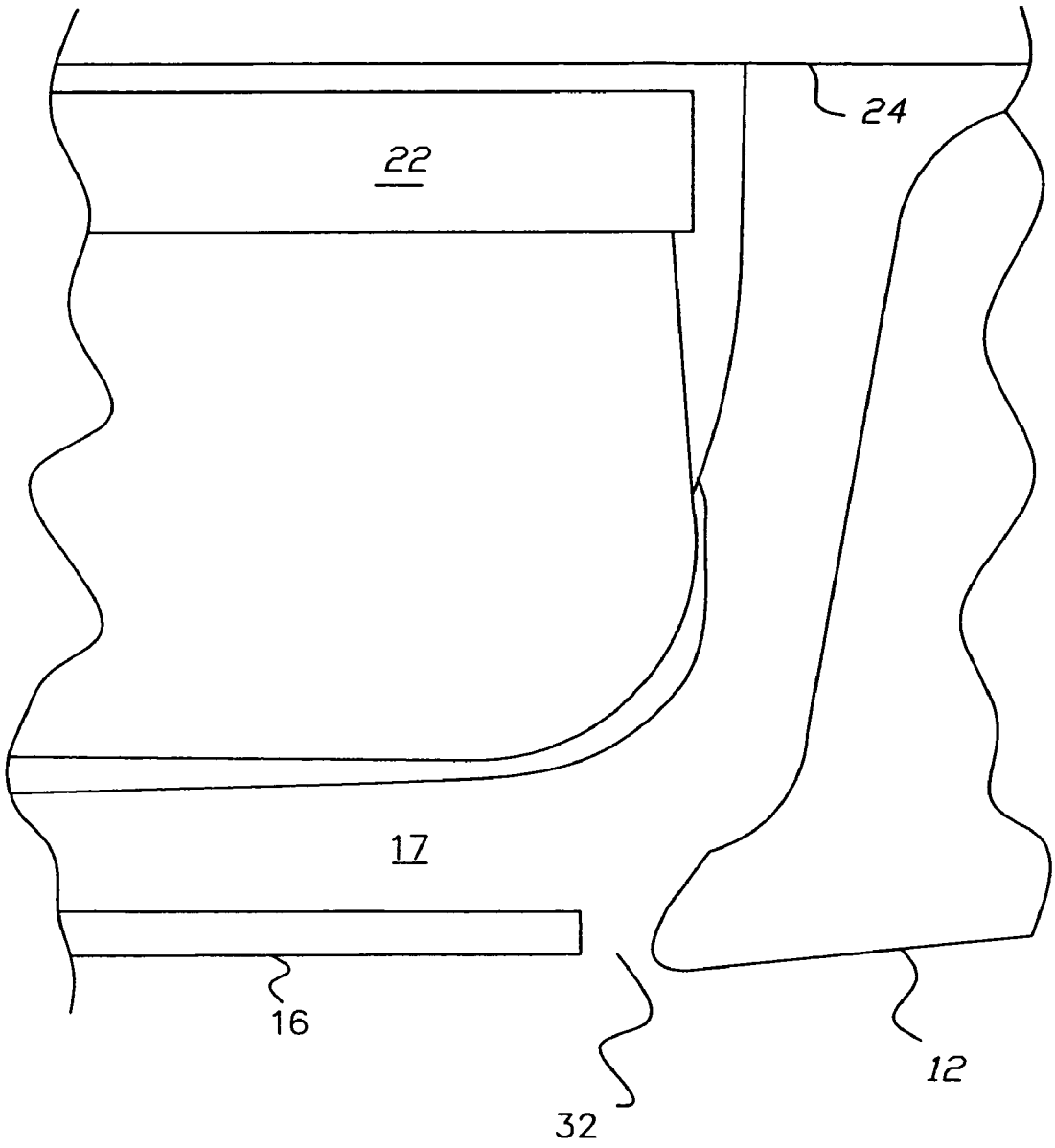
FIG. 5 depicts a detail cross sectional view of the eyelid and catcher according to the embodied methods.

As shown in FIG. 4 and FIG. 5, the eyelid 12 can movably seal against the catcher flow pan 16 and the catcher 14. An eyelid actuator 30 is adapted to open or close the eyelid against the catcher flow pan and the catcher. Both FIG. 4 and FIG. 5 depict the eyelid in the unsealed position.

The eyelid 12 shown in FIG. 5 is in the unsealed position forming a gap 32 between the eyelid 12 and the catcher flow pan 16. The creation of the gap 32 lowers the concentration of ink solvent vapors in the vicinity of the catcher. This reduction in solvent vapors suppresses the Marangoni Effect.

Low surface tension inks that are usable with this inventive method can be solvent-based inks, such as methyl ethyl ketone inks, ethanol-based inks, acetone-based inks, ethyl acetate-based inks, or inks with propanol, butanol, toluene, xylene, or hexane. The inks can also be combinations of the listed examples.

The embodiments have been described in detail with particular reference to certain preferred embodiments thereof, but it will be understood that variations and modifications can be effected within the scope of the embodiments, especially to those skilled in the art.

PARTS LIST

12. eyelid
14. catcher
16. catcher flow pan
17. channel
18. drop generator
19*a*. print drops
19*b*. print drops
20*a*. non-print drops
20*b*. non-print drops
21. jet array
22. charge device
24. orifice structure
26. ink supply line
28. ink return line
29. reservoir of ink
30. eyelid actuator
32. gap

What is claimed is:

1. A method for controlling ink migration onto a catcher of an ink jet print station from a catch condition using a low surface tension ink, wherein an ink jet print station includes a drop generator that has an orifice structure with orifices for forming a jet array and that is connected to an ink reservoir, a charge device for charging recycle drops from the jet array, a catcher with a catcher flow pan, and an eyelid with an eyelid actuator for sealably engaging the eyelid against the catcher and catcher flow pan, and wherein the method comprises the steps successively of:

a. bringing the ink jet print station, using the low surface tension ink, into the catch condition with the eyelid sealably engaging against the catcher and the catcher flow pan;

b. using the eyelid actuator to unseal the eyelid from against the catcher and the catcher flow pan, which forms a gap between the catcher flow pan, the catcher and the eyelid that lowers the concentration of ink solvent vapors in the vicinity of the catcher to thereby suppress a Marangoni Effect; and c. then operating the ink jet print station with the eyelid unsealed to suppress migration of the low surface tension ink onto the catcher during a standby mode.

2. The method of claim 1, wherein the low surface tension ink is volatile.

3. The method of claim 2, wherein a volatile low surface tension ink is a solvent based ink.

4. The method of claim 3, wherein the solvent based ink is an ink comprising a member of the group consisting of methyl ethyl ketone, ethanol, acetone, ethyl acetate, propanol, butanol, toluene, xylene, hexane, and combinations thereof.

5. The method of claim 1, wherein the time interval between the catch condition and the standby mode is less than one second.

6. An ink jet print station using a low surface tension ink, wherein the ink jet print station comprises a drop generator that has an orifice structure with orifices for forming a jet array and that is connected to an ink reservoir, a charge device for charging recycle drops from the jet array, a catcher with a catcher flow pan, and an eyelid with an eyelid actuator for sealably engaging the eyelid against the catcher and catcher flow pan, and further wherein:

a. the ink jet print station is adapted to be in a catch condition with the eyelid sealably engaging against the catcher and the catcher flow pan;

b. an eyelid actuator for unsealing the eyelid from against the catcher and the catcher flow pan, which forms a gap between the catcher flow pan, the catcher and the eyelid that lowers the concentration of ink solvent vapors in the vicinity of the catcher to thereby suppress a Marangoni Effect; and c. the ink jet print station has a standby mode and is adapted to be operated with the eyelid unsealed to suppress migration of the low surface tension ink onto the catcher during the standby mode.

* * * * *